US007065974B2

(12) United States Patent
Grenfell

(10) Patent No.: US 7,065,974 B2
(45) Date of Patent: Jun. 27, 2006

(54) METHOD AND APPARATUS FOR PRESSURIZING A GAS

(76) Inventor: Conrad Q. Grenfell, 1222 Longlodge, Taylor Lake Village, TX (US) 77586

( * ) Notice: Subject to any disclaimer, the term of this patent is extended or adjusted under 35 U.S.C. 154(b) by 0 days.

(21) Appl. No.: 10/816,236

(22) Filed: Mar. 31, 2004

(65) Prior Publication Data

US 2004/0194499 A1 Oct. 7, 2004

Related U.S. Application Data

(60) Provisional application No. 60/459,893, filed on Apr. 1, 2003.

(51) Int. Cl.
*F17C 9/04* (2006.01)
*F17C 9/02* (2006.01)
*F25J 1/00* (2006.01)

(52) U.S. Cl. ..... 62/50.3; 62/50.2; 62/613

(58) Field of Classification Search ..... 62/50.1, 62/50.2, 50.3, 50.6, 50.7, 611, 613
See application file for complete search history.

(56) References Cited

U.S. PATENT DOCUMENTS

| | | | | |
|---|---|---|---|---|
| 2,550,844 A | | 5/1951 | Meiller et al. | 48/190 |
| 2,810,263 A | | 10/1957 | Raymond | 61/0.5 |
| 3,195,316 A | | 7/1965 | Maher et al. | 62/52 |
| 3,229,472 A | | 1/1966 | Beers | 62/53 |
| 3,331,214 A | | 7/1967 | Proctor et al. | 62/20 |
| 3,735,600 A | * | 5/1973 | Dowdell et al. | 62/619 |
| 3,848,427 A | | 11/1974 | Loofbourow | 62/260 |
| 3,867,811 A | | 2/1975 | Waeselynck | 60/39.03 |
| 4,805,674 A | | 2/1989 | Knowlton | 141/47 |
| 4,858,640 A | | 8/1989 | Kaufmann | 137/236.1 |
| 4,961,325 A | | 10/1990 | Halvorson et al. | 62/48.1 |
| 5,107,906 A | | 4/1992 | Swenson et al. | 141/11 |
| 5,207,530 A | | 5/1993 | Brooks et al. | 405/53 |
| 5,505,232 A | * | 4/1996 | Barclay | 141/11 |
| 5,630,328 A | | 5/1997 | Hise et al. | 62/619 |
| 5,934,081 A | | 8/1999 | Notaro et al. | 62/50.2 |
| 6,023,933 A | | 2/2000 | Langan et al. | 62/50.2 |
| 6,085,546 A | | 7/2000 | Johnston | 62/613 |
| 6,085,547 A | | 7/2000 | Johnston | 62/613 |
| 6,089,028 A | | 7/2000 | Bowen et al. | 62/50.2 |
| 6,105,390 A | | 8/2000 | Bingham et al. | 62/613 |
| 6,298,671 B1 | | 10/2001 | Kennelley et al. | 62/50.2 |
| 6,333,445 B1 | | 12/2001 | O Brien | 585/809 |
| 6,354,088 B1 | * | 3/2002 | Emmer et al. | 62/50.1 |
| 6,374,844 B1 | * | 4/2002 | Hall | 137/1 |
| 6,412,302 B1 | | 7/2002 | Foglietta | 62/611 |

(Continued)

*Primary Examiner*—William C. Doerrler
(74) *Attorney, Agent, or Firm*—Sierra Patent Group, Ltd.

(57) ABSTRACT

A gas pressurization system comprising a gas inlet valve configured to receive an inlet gas stream. A clean-up system is coupled to the gas inlet valve. A recovery heat exchanger coupled to the clean-up system. The recovery heat exchanger is configured to remove thermal energy from the inlet gas stream and cool the inlet gas stream to one of a pre-cooled gas and liquid stream. An expander coupled to the recovery heat exchanger is configured to expand the pre-cooled liquid stream. A refrigeration unit coupled to the expander and configured to cool the expanded pre-cooled liquid stream to a liquid phase. A buffer storage unit is coupled to the refrigeration unit. A pump is coupled to the buffer storage unit at a pump suction and has a pump discharge coupled to the recovery heat exchanger. A high-pressure storage unit coupled to the pump discharge downstream of the recovery heat exchanger.

19 Claims, 6 Drawing Sheets

U.S. PATENT DOCUMENTS 6,425,263 B1 7/2002 Bingham et al. ..... 62/613
6,516,616 B1 2/2003 Carver et al. ..... 60/659
6,517,286 B1 2/2003 Latchem ..... 405/53
2002/0174678 A1 11/2002 Wilding et al. ..... 62/602

* cited by examiner

METHOD AND APPARATUS FOR PRESSURIZING A GAS

PRIORITY

This application claims priority to Provisional Patent Application No. 60/459,893, filed on Apr. 1, 2003.

BACKGROUND

The present disclosed device and disclosed system relates generally to pressurizing (charging) natural gas into high-pressure storage reservoirs. Particularly, the disclosed system utilizes a pipeline or other natural gas source together with a liquefaction process system, an incompressible liquid pumping system and re-gasification vaporization for liquefaction energy recovery, to charge (pressurize) underground or above ground storage reservoir facilities or containers (systems) with high-pressure natural gas.

Present methods for charging or pressurizing underground natural gas storage reservoirs (systems), utilize an engine driven or electrical driven mechanical gas compressor system. The compressor system usually consists of a compressor driver, compressor, inner-stage and after compression, air or coolant heat exchangers and compresses the natural gas from a low or moderate pressure to the high pressure. The high pressure may range from approximately 2,000 psig to 4,000 psi or higher, for charging (pressurizing), the underground storage reservoir. This technique is practiced in order to store natural gas in large quantities to provide for high peak demand periods for delivery to pipeline customers. In many locations throughout the World, the pipeline supply of natural gas is insufficient to meet the winter or other high demand periods, therefore underground storage of high-pressure natural gas has been utilized for many years to supplement the pipeline supply for these peak demand periods.

What is needed in the art is a more efficient system for pressurizing natural gas for storage of high-pressure natural gas.

SUMMARY

The invention described herein provides a new process method to develop the high pressure necessary for charging (pressurizing) natural gas into storage reservoirs. This invention process liquefies the natural gas and pumps the Liquefied Natural Gas fluid, which is a cold liquid, near-cryogenic or is a cryogenic, incompressible fluid, to the high pressure necessary for charging (pressurizing) underground and or above ground storage facilities. Pumping of the incompressible cold, near-cryogenic or cryogenic liquefied natural gas (LNG) requires significant less energy, from approximately 62 percent to 24 percent less than that required for gas compression, currently used by mechanical compressors to charge underground or above ground storage reservoir facilities. This particular energy comparison example is based on using a three stage ethylene refrigeration system verses a conventional high-pressure natural gas compressor. Other, more efficient refrigeration systems may give greater energy savings, but their use will depend on the size and scope of each project as to whether the project justifies the additional complexity.

The liquefied natural gas is re-gasified (vaporized) as part of the invention process for pre-cooling the natural gas to be liquefied, prior to being charged into the storage reservoir. The vaporized gas from the process remains at the high pressure for charging into the storage reservoir; only the cold temperature and refrigeration energy has been removed and exchanged to the natural gas entering the process system for liquefaction. Depending on the pressure of the inlet gas and the desired outlet pressure of the gas, the invention vaporization process recovers up to 90% percent of the refrigeration energy that is necessary to liquefy the inlet natural gas stream in the process. Additional refrigeration energy, above that recovered by this process, is required to complete the liquefaction process in order that the gas stream is fully liquefied to a saturated and/or sub-cooled liquid phase for pumping to the storage reservoir high-pressure requirements.

The invention is further described as a incompressible, near-cryogenic or cryogenic liquefied gas system, abbreviated as the "ICF Process System", for pressurizing (charging) high pressure natural gas into storage reservoirs systems, such as underground, above ground facilities or storage containers. Natural gas is provided to the ICF Process System from the pipeline or other source at a nominal, moderate or near high inlet pressure at near ambient temperature.

The invention, ICF Process System, pre-treats the inlet gas stream to remove the excess water, carbon dioxide, other temperature sensitive hydrocarbon compounds and any other undesirable impurities from the inlet gas stream to the process, as necessary for liquefaction of the natural gas stream. The ICF Process System utilizes a refrigeration system to chill the ambient inlet gas stream during the pre-treatment process to assist in the removal of undesirable impurities. This chilling of the inlet gas stream to remove impurities also provides a net savings of downstream refrigeration energy requirements.

In addition, a still further object of this invention, the ICF Process System further refrigerates the chilled inlet stream in a counter flow type or other heat exchanger by transferring the recovered cold temperature to the inlet gas stream from the high pressure, near-cryogenic or cryogenic liquefied natural gas stream. This, heat exchange method vaporizes and re-gasifies the liquefied high pressure natural gas stream to a near ambient condition for charging (pressurizing) the storage facilities or containers with high pressure natural gas.

The ICF Process System further refrigerates the inlet gas stream by either an Isentropic Turbo-expander unit or a Joule-Thomson Isenthalpic expansion valve process. It is still a further object of this invention to provide additional refrigeration to the natural gas stream for complete liquefaction and/or sub-cooling of the natural gas stream using a mechanical refrigeration system. The mechanical refrigeration system would be installed downstream of Turbo-expander or Joule-Thomson valve, utilizing whichever of these two expansion devices is preferred to provide for the additional refrigeration effect to the ICF Process System.

Refrigeration systems that use refrigerants for attaining low temperatures, including Propane, Propylene, Ethylene, Ethane, Methane and Nitrogen individually or mixed in a Cascade refrigeration and or Closed loop system can be used to provide, the additional required liquefaction refrigeration. In addition, a mixed refrigerant type of refrigeration system where mixtures of Propane, Propylene, Ethylene, Ethane, Methane and or Nitrogen, can be used to provide the near-cryogenic or cryogenic liquefaction of the natural gas stream. Further, the ICF Process System embodies a gas or gas liquid two phase and or single phase liquid mixture fluid expansion devices, such as a Turbo-Expander and or Joule-Thomson valve to provide additional refrigeration effects to the natural gas stream. These gas or gas-liquid expansion devises would be installed between the natural gas stream pre-cool heat exchanger and low temperature refrigeration system and or between the additional refrigeration system and the incompressible liquid pump, for maximum refrigeration efficiency and energy conservation.

The ICF Process System provides an improved method and process with less total energy required to charge (pressurize), underground and or aboveground storage facilities, (storage containers) with high-pressure natural gas. The amount of energy conserved and overall ICF system efficiency, is a function of the pipeline or other gas supply inlet pressure to the ICF Process System and the high pressure natural gas pressure developed by the incompressible fluid pump to charge (pressurize) the storage facilities and or storage containers with natural gas. Depending on the inlet pressure available and the discharge pressure desired, the ICF Process System requires as much as 60% and possibly greater, less total energy, than a conventional gas compressor system.

The disclosed device is directed toward a gas pressurization system comprising a gas inlet valve configured to receive an inlet gas stream. A clean-up system is coupled to the gas inlet valve. The clean-up system is configured to remove impurities from the inlet gas stream. A recovery heat exchanger is coupled to the clean-up system. The recovery heat exchanger is configured to remove thermal energy from the inlet gas stream and consequently cools the inlet gas stream to a pre-cooled gas an/or liquid stream. An expander is coupled to the recovery heat exchanger. The expander is configured to expand the pre-cooled liquid stream into a two-phase fluid. A refrigeration unit is coupled to the expander. The refrigeration unit is configured to cool the two-phase fluid to a liquid phase fluid. A buffer storage unit is coupled to the refrigeration unit. The buffer storage unit is configured to provide a net positive suction head. A pump is coupled to the buffer storage unit at a pump suction and the pump has a pump discharge coupled to the recovery heat exchanger. The recovery heat exchanger is configured to transfer thermal energy from the inlet gas stream to a liquid discharge from the pump discharge. A high-pressure storage unit is coupled to the pump discharge downstream of the recovery heat exchanger.

The disclosure is directed toward another embodiment of a gas pressurization system. The gas pressurization system comprises a gas inlet valve configured to receive an inlet natural gas stream. A clean-up system is coupled to the gas inlet valve. The clean-up system is configured to remove impurities from the inlet natural gas stream. A recovery heat exchanger is coupled to the clean-up system. The recovery heat exchanger is configured to remove thermal energy from the inlet natural gas stream and cool the inlet natural gas stream to a pre-cooled gas and/or liquefied natural gas stream. An expander is coupled to the recovery heat exchanger. The expander is configured to expand the pre-cooled gas and/or liquefied natural gas stream into a two-phase fluid. A refrigeration unit is coupled to the expander. The refrigeration unit is configured to cool the two-phase fluid to a liquid phase. A buffer storage unit is coupled to the refrigeration unit. The buffer storage unit is configured to provide a net positive suction head. A pump is coupled to the buffer storage unit at a pump suction and the pump having a pump discharge coupled to the recovery heat exchanger. The recovery heat exchanger is configured to transfer thermal energy from the inlet gas stream to a liquefied natural gas discharge from the pump discharge. A high-pressure storage unit is coupled to the pump discharge downstream of the recovery heat exchanger.

A method of pressurizing a gas is disclosed comprising flowing a gas through a gas inlet valve. The method includes removing impurities from the gas. The method includes precooling the gas in a recovery heat exchanger into a gas and/or a liquid phase. The method includes expanding the gas and/or liquid phase to a two-phase fluid through an expander. The method includes cooling the two-phase fluid to a saturated or sub-cooled liquid. The method includes storing the saturated or sub-cooled liquid in a buffer storage unit. The method includes maintaining a net positive suction head in the saturated or sub-cooled liquid. The method includes pumping the saturated or sub-cooled liquid with a pump through the recovery heat exchanger. The method includes exchanging thermal energy from the inlet gas to the saturated or sub-cooled liquid in the recovery heat exchanger. The method includes storing an ambient gas in a high-pressure storage unit.

DETAILED DESCRIPTION

The present invention generally contemplates the charging or pressurizing of underground natural gas reservoirs by pre-treating and liquefaction of a natural gas stream, after pumping said liquefied gas stream to a high pressure, vaporizing the liquefied gas stream for heat exchange cooling energy recovery to the inlet natural gas stream for sub-cooling, said inlet gas stream prior to liquefaction. Additional cooling of the natural gas stream prior to the complete liquefaction is accomplished by expansion of the sub-cooled natural gas stream from a higher to a lower pressure. Expansion of the sub-cooled natural gas is accomplished by either or a combination of a Joule-Thomson valve devise and/or a turbo-expander devise.

Precooling of the inlet gas stream by the ICF Process system, recovers from approximately 40 to 90 percent of the liquefaction refrigeration energy. Refrigeration energy recovery is dependent on the inlet natural gas pressure to the ICF Process System, heat exchange refrigeration energy recovery efficiency and charging pressure to the natural gas reservoir facilities and or storage container systems. Consequently, the complete liquefaction of the inlet gas stream to a saturated and or sub-cooled liquid phase now requires only the differential refrigeration energy from the recovered refrigeration energy to the total required for complete liquefaction of the natural gas stream.

Figure 1:
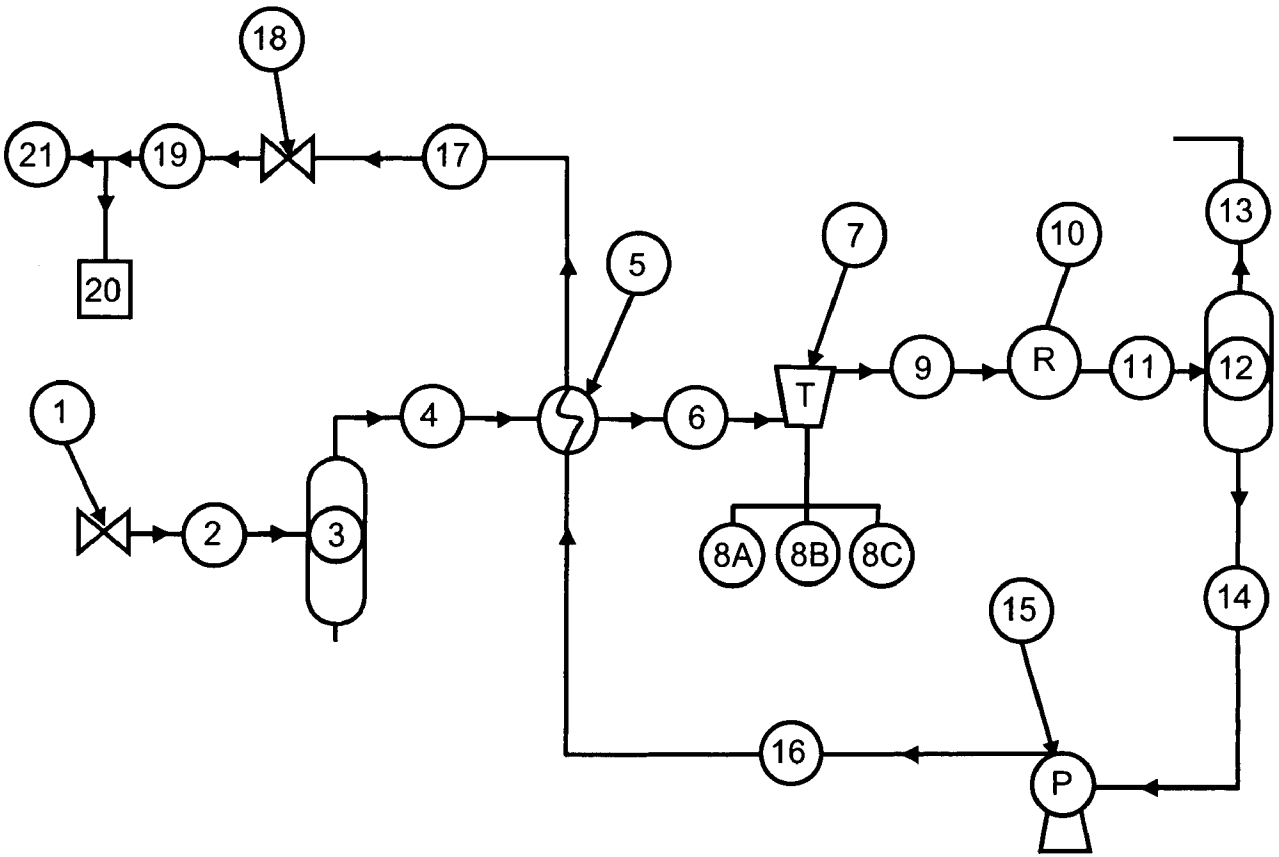
FIG. 1 is a schematic of an exemplary liquefied natural gas process system.

Referring to FIG. 1 the ICF Process System schematic embodies an inlet shutoff control valve 1, an inlet natural gas stream 2, a natural gas stream pre-treatment clean up sub-system 3, a natural gas stream 4, removed of water, carbon dioxide, C6+, heavy hydrocarbons and any other undesirable impurities such as sulfur compounds, a refrigeration energy recovery heat exchanger 5, a pre-cooled natural gas stream 6, a turbo-expander isentropic expansion device 7, a turbo-expander energy absorbing device, electric generator 8A or gas compressor 8B, or hydraulic pump mechanism 8C, a two phase cooled natural gas stream 9, a mechanical refrigeration unit 10, a saturated and or sub-cooled natural gas stream 11, a buffer LNG storage unit 12, a natural gas fuel gas line 13, a liquefied natural gas pump suction stream 14, a incompressible fluid pump 15, a high pressure LNG fluid pump discharge stream 16, a high pressure near ambient temperature natural gas stream 17, high pressure control valve 18, high pressure natural gas stream 19, underground natural gas storage facilities 20, and/or above ground Natural Gas storage containers 21.

Natural gas stream 2 enters the ICF Process System at shutoff control valve 1, and is processed by a pre-treatment clean up sub-system 3, where, water, carbon dioxide, impurities and C6+ heavy hydrocarbons are removed from the natural gas stream to acceptable levels for liquefaction of the natural gas stream. The gas pre-treatment clean up sub-system 3 can be comprised of any number of standard commercial or industrial processes that are used to remove water, carbon dioxide, impurities and or other heavy hydrocarbon compounds from natural gas streams, such as Amine processes, Molecular Sieves processes, Methanol processes, Activated Charcoal processes or suitable pre-treatment clean up process combinations thereof. Valve 2 controls natural gas stream 1, entering the ICF Process System.

After, the inlet natural gas stream 2, has been processed to remove the water, carbon dioxide, impurities and C6+ heavy hydrocarbons from the natural gas stream by the clean up sub-system 3, the natural gas stream that is essentially free of water and carbon dioxide 4, is piped to the recovery heat exchanger 5, for pre-cooling the natural gas stream by recovering the refrigeration energy, prior to entering an expander 7. For refrigeration energy recovery, the high pressure liquefied natural gas stream 16, is counter-flowed to the recovery heat exchanger 5, by the incompressible fluid pump 15, after liquefaction of the natural gas stream 11, by the mechanical refrigeration system 10, as withdrawn through the liquefied natural stream 14, from the buffer storage unit 12.

Isentropic processing through the expander device 7, further cools the pre-cooled natural gas stream 6. This isentropic expansion caused by the natural gas stream pressure drop across the expander device 7, provides additional refrigeration effect to the pre-cooled natural gas stream 9, prior to entering the mechanical refrigeration unit 10. In an exemplary embodiment, the expander is a turbo-expander device 7, as used in the ICF Process system, that drives an energy absorbing device, either an electric generator 8A, or gas compressor 8B, or hydraulic pump 8C. The electric generator 8A, when installed, provides electric power during turbo-expander 7 operation, the gas compressor 8B, when installed, provides gas compression during turbo-expander 7 operation, either energy absorbing device provides further energy conservation by the ICF Process System.

The amount of electrical energy generated by the turbo-expander generator 8A, is a function of the pre-cooled natural gas stream 6, pressure and temperature entering the turbo-expander 7, natural gas steam pressure drop and temperature change, stream 6 to stream 9, through the turbo-expander 7, isentropic gas expansion process. The turbo-expander thermal efficiency directly affects the power generation capability of the turbo-expander electric generator 8A, during ICF Process System operation. Electrical power generated by the electrical generator 8A can be utilized in the ICF Process System to off set electrical power required by the incompressible fluid pump 15, when driven by an electric motor.

The electrical power developed by the turbo-expander driven electrical generator 8A is variable, but near constant, when the turbo-expander devise 7, operates at a near constant pressure, temperature, flow rate from the natural gas pre-cooled inlet stream 6 and exiting two phase cooled stream 9. The power output of the turbo-electric generator 8A is generally less than the power required by the incompressible fluid pump motor 15 and therefore additional power from the local electrical grid or an electric generator is required for ICF Process System operation.

When installed, the hydraulic pump mechanism 8C is driven by the turbo-expander 7, and provides hydraulic power to drive mechanical and or refrigeration system motor components. The hydraulic pump 8C, power that is developed, is a function of the pre-cooled inlet stream 6, pressure and temperature entering the turbo-expander 7, natural gas stream pressure drop 6, to stream 9, through the turbo-expander 7, isentropic gas expansion process.

The Natural Gas stream exiting the turbo-expander device 7 is further cooled into a two-phase (liquid & gas) natural gas stream 9, prior to entering the mechanical refrigeration unit 10. Where, the two-phase natural gas stream 9 is further cooled to a saturated liquid and or sub-cooled liquid stream 11. From the Mechanical Refrigeration unit 10, the saturated and or sub-cooled natural gas stream 11, is transferred to a buffer storage unit 12, prior to entering the incompressible fluid pump 15. The buffer storage unit 12 provides sufficient volume and liquid head to the incompressible fluid pump 15, to maintain efficient pumping without pump cavitation during start up, steady state operations and shutdown conditions.

The incompressible fluid pump 15, is designed to raise the liquefied natural gas fluid to the high pressure necessary to charge (pressurize), underground reservoir facilities 20, and or above ground storage containers 21, with high pressure natural gas at near ambient temperature. The incompressible fluid pump 15, may be one or more fluid pumps in series and or in parallel, dependent upon the natural gas stream volume and pressure requirements for charging (pressurizing) the underground reservoir facilities 20, and or storage containers 21. Underground reservoir facilities 20 may comprise at least one of a depleted natural gas or oil field, an aquifier, and a salt cavern.

The ICF Process System is a continuous process and has been invented to recover a large portion of the refrigeration energy required to liquefy the natural gas stream. Heat gain to the near-cryogenic or cryogenic ICF process system equipment, such as the pre-cooling heat exchanger 5, turbo-expander devise 7, mechanical refrigeration unit 10, buffer storage unit 12, incompressible liquid pump 15 and natural gas streams 4, 6, 9, 11, 14 and 16 shall be highly insulated to minimize the refrigeration losses due to thermal radiation and conduction.

A natural gas engine would, preferably power the mechanical refrigeration unit 10. Diesel or LP gas engine drives may also be suitable, however natural gas would be the fuel of choice. If the mechanical refrigeration unit 10 is powered by an electrical motor and the incompressible fluid pump 15 is powered by a engine driven electrical generator set, the electrical power generated by the turbo-expander driven electrical generator 8A, can be used to offset the power requirement of the mechanical refrigeration unit 10 electrical motor. Thereby, providing a minimum requirement for external electrical power to the ICF Process System.

Figure 2:
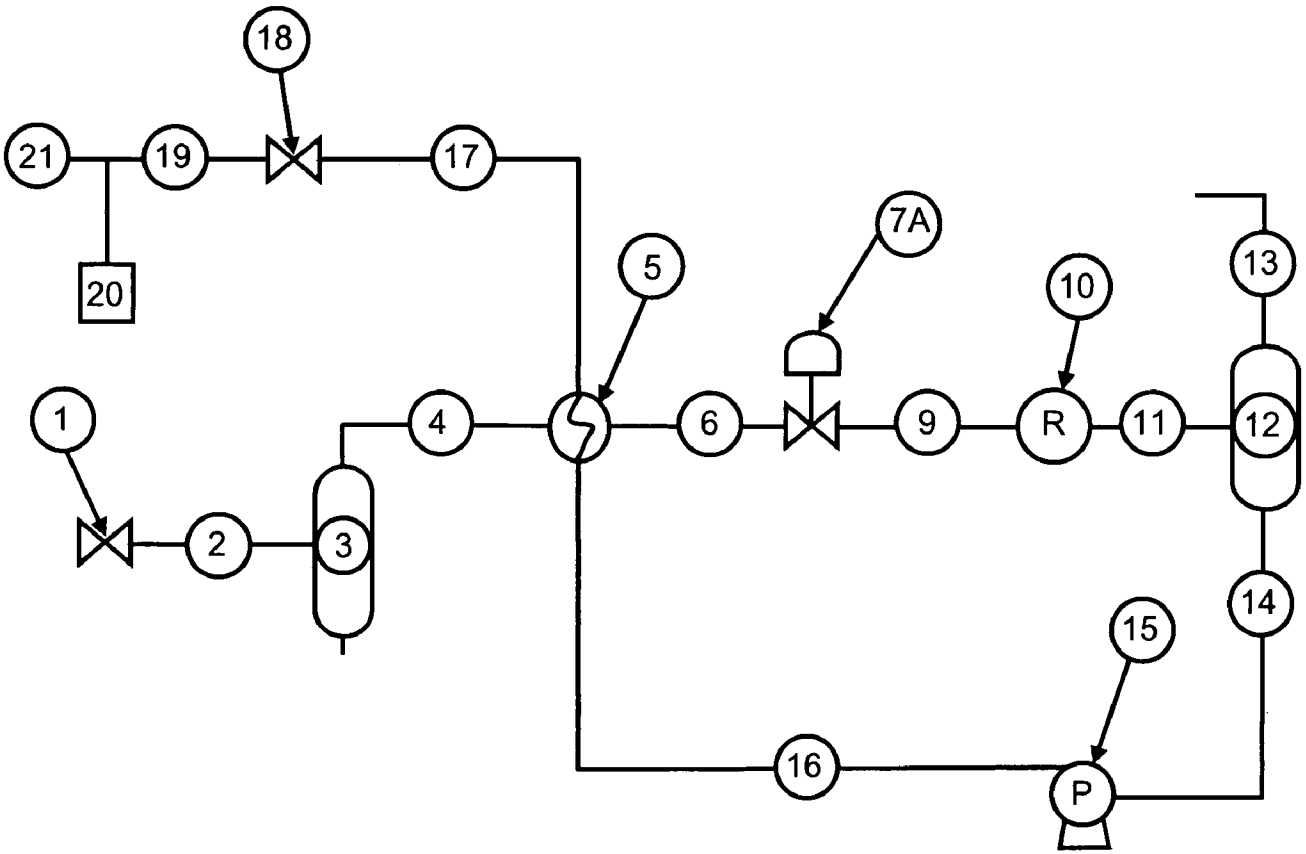
FIG. 2 is a schematic of another exemplary liquefied natural gas process system.
Figure 3:
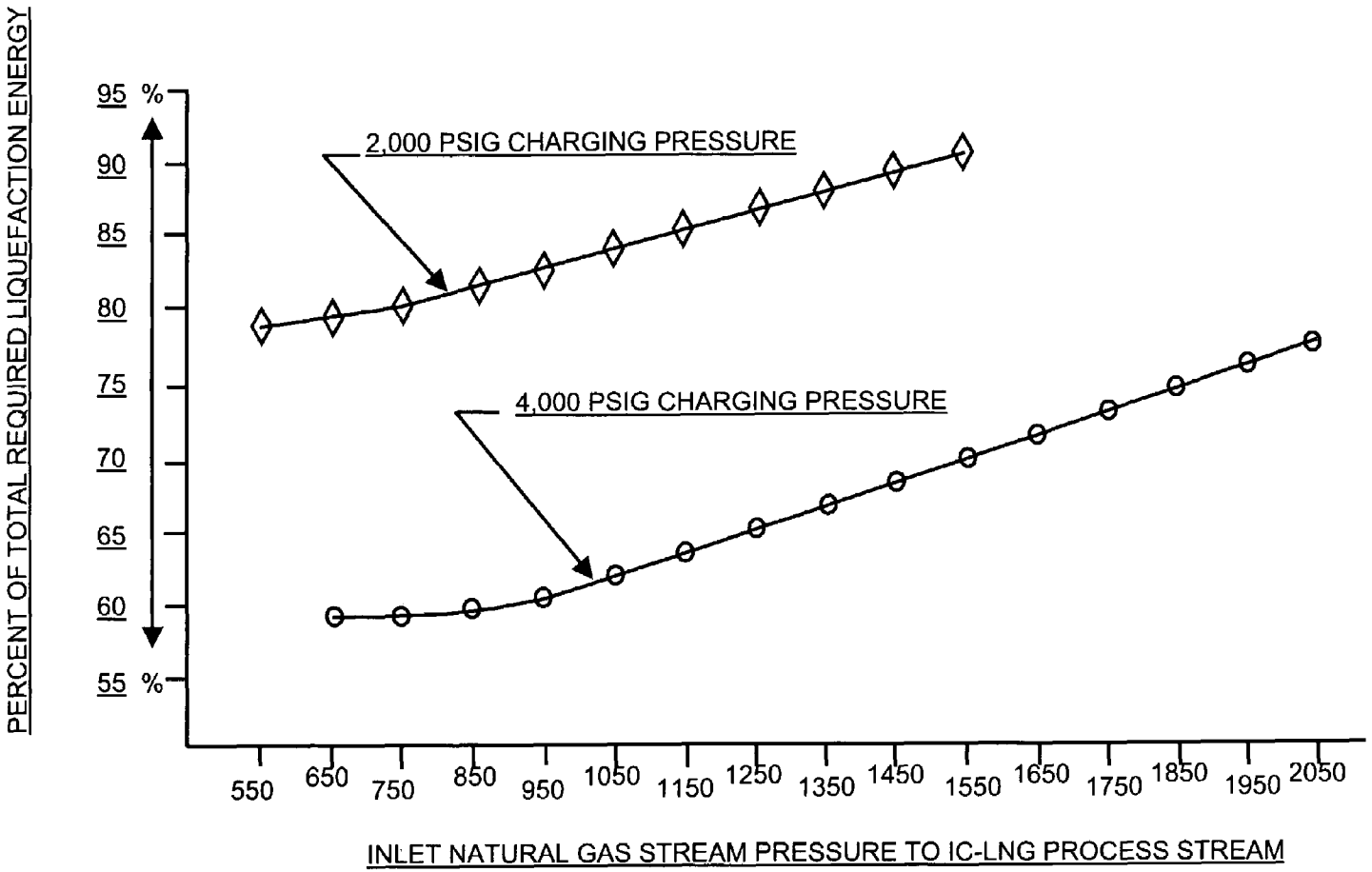
FIG. 3 is a graphical illustration of the Refrigeration Energy Recovery by the ICF Process System, as a percent of the total liquefaction energy required versus various inlet natural gas pressures to the ICF Process System, for developing charging pressures of 2,000 psig and 4,000 psig, when using the Turbo-Expander Device.
Figure 4:
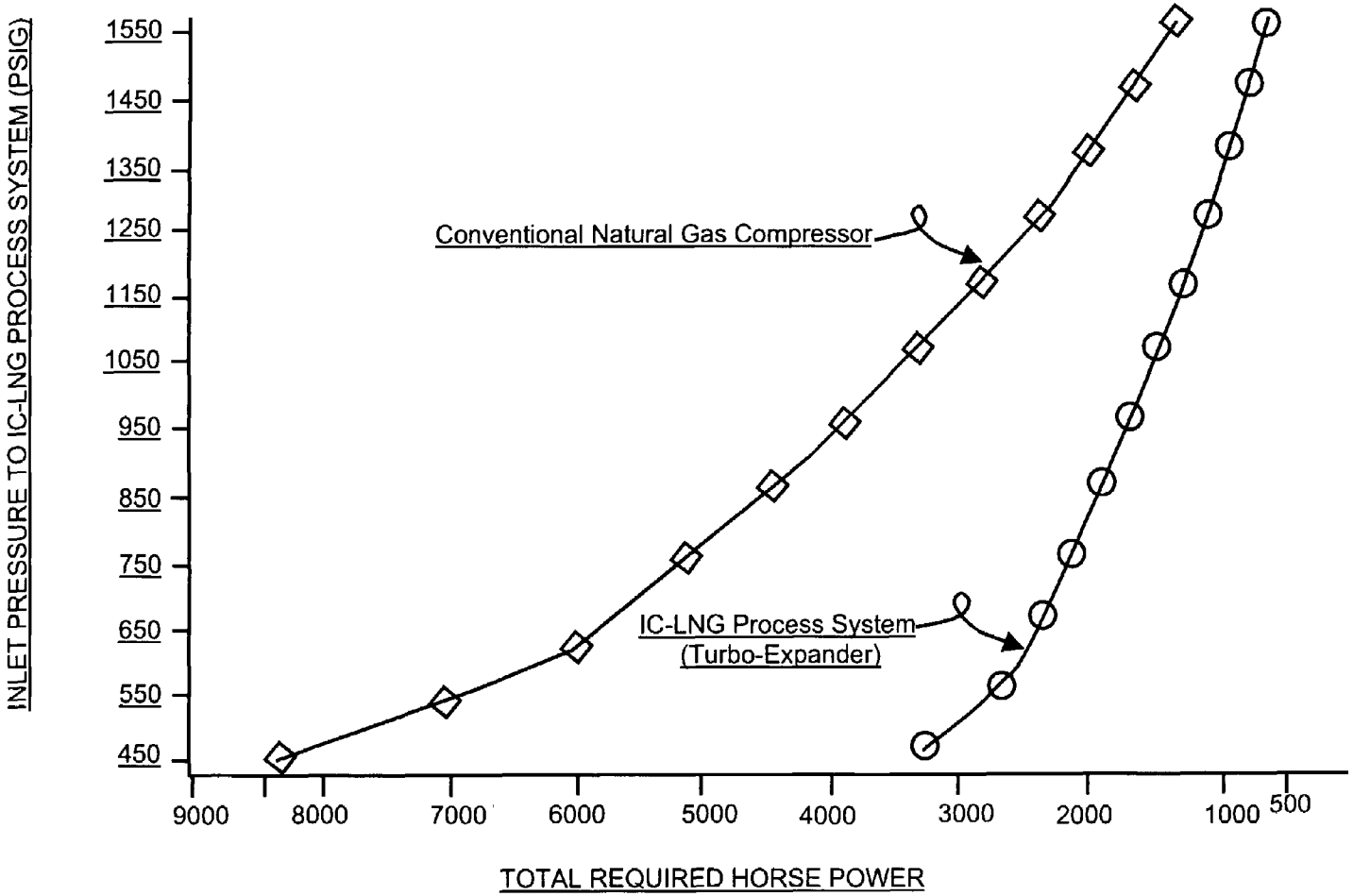
FIG. 4 is a graphical illustration of the difference in Horse Power required for a Gas Compressor System verses an exemplary ICF Process System, using a Turbo-Expander Isentropic Expansion device to charge (pressurize) natural gas storage reservoir facilities and or storage containers to 2,000 psig.
Figure 5:
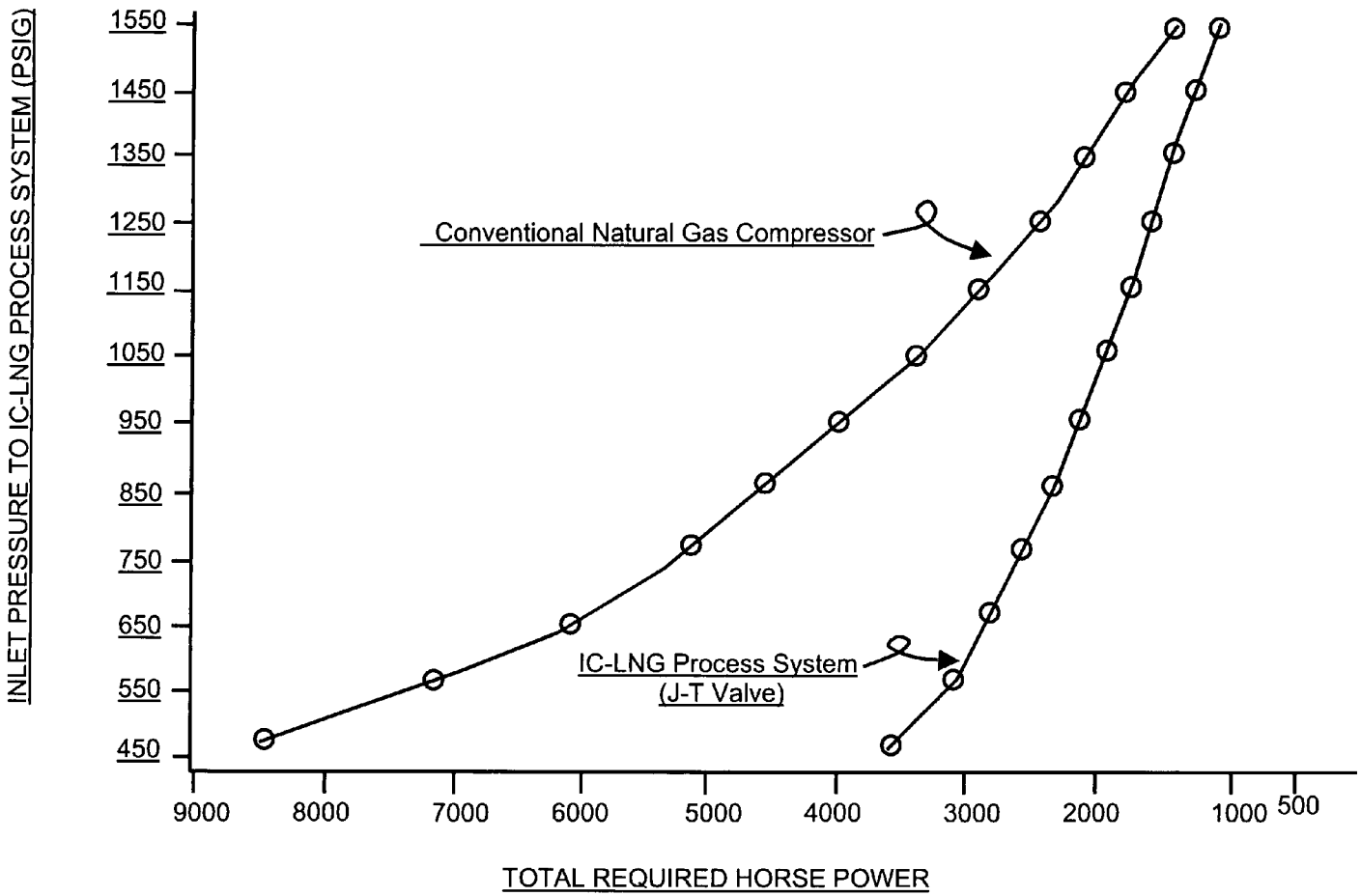
FIG. 5 is a graphical illustration of the difference in Horse Power required between a Gas Compressor System and an exemplary ICF Process System, using a Joule-Thomson" Isenthalpic expansion valve to charge (pressurize) natural gas storage reservoir facilities and or storage container systems to 2,000 psig.
Figure 6:
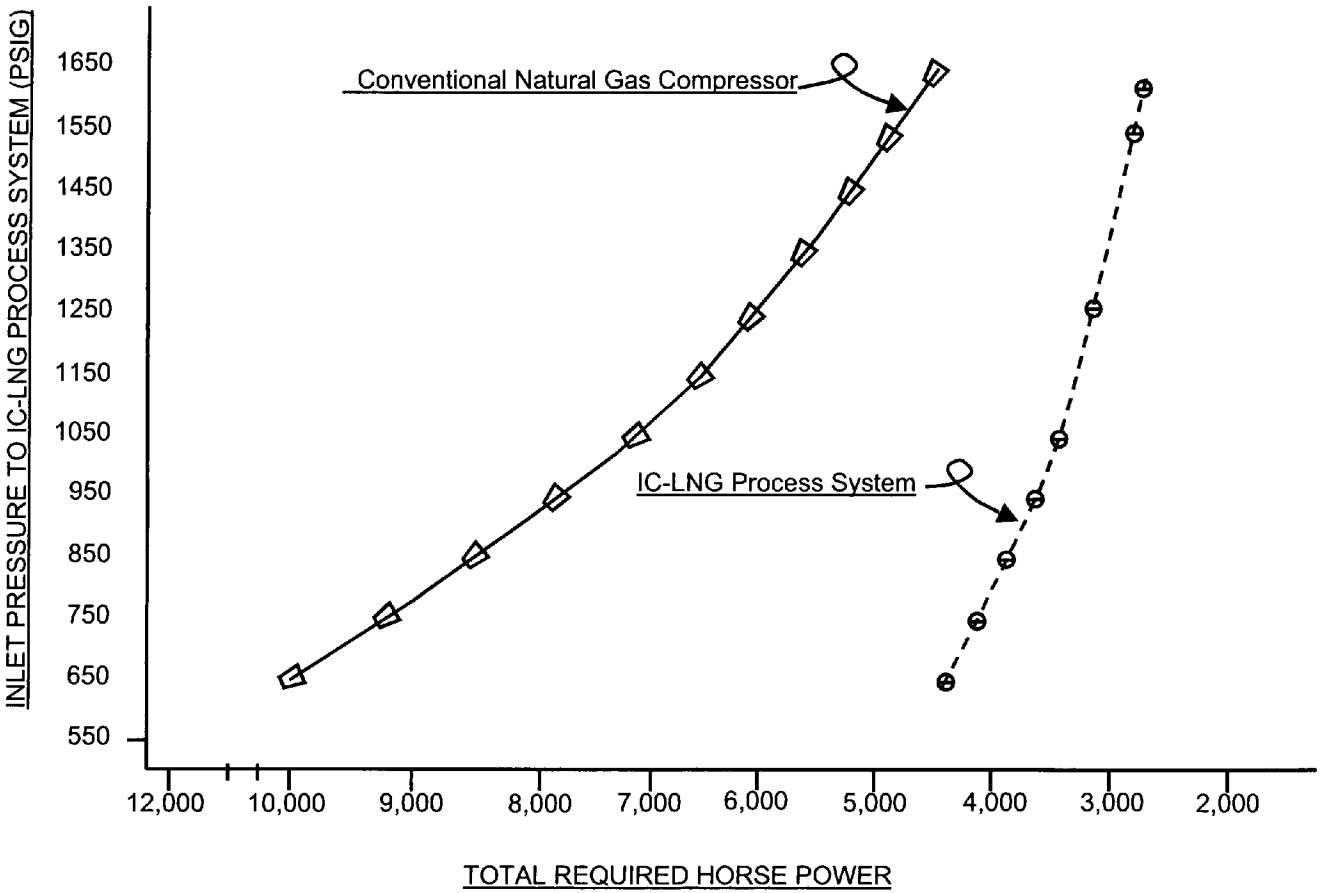
FIG. 6 is a graphical illustration of the difference in Horse Power requirements between a Gas Compressor System and an exemplary ICF Turbo-Expander Process System to charge (pressurize) natural gas reservoir facilities and or storage container systems to 4,000 psig.

Referring to FIG. 2, the FIG. 2 schematic of the ICF Process System embodies an inlet shutoff control valve 1, and inlet natural gas stream 2, a natural gas clean up sub-system 3, a natural gas stream removed of water, carbon dioxide, impurities and C6+ heavy hydrocarbons 4, a refrigeration energy recovery heat exchanger 5, a Joule-Thomson gas expansion device (7A) a two phase cooled natural gas stream 9, a mechanical refrigeration unit 10, a saturated and/or sub-cooled natural gas stream 11, a liquefied natural gas buffer storage unit 12, a natural gas fuel gas line 13, a liquefied natural gas pump suction stream 14, a incompressible fluid pump 15, a high pressure LNG fluid pump discharge stream 16, a high pressure near ambient temperature natural gas stream 17, high pressure control valve 18 high pressure natural gas stream 19, underground storage facilities 20 and or above ground storage containers 21.

Natural gas stream 2 enters the ICF Process System at shutoff valve 1, and is processed by a pre-treatment clean up sub-system 3 where water, carbon dioxide, impurities and C6+ heavy hydrocarbon compounds are removed to acceptable levels for liquefaction of the natural gas stream. The gas pre-treatment clean up sub system 3, can be comprised of any number of standard commercial or industrial processes that are used to remove water, carbon dioxide, impurities and C6+ heavy hydrocarbon compounds from natural gas streams, such as Amine processes, Molecular Sieves processes, Methanol processes, Charcoal processes and or combinations of these or suitable pre-treatment clean up processes.

After the inlet natural gas stream 2, has been processed by the pre-treatment clean up sub-system 3, the natural gas stream 4, enters an energy recovery heat exchanger 5, to pre-cooled and recover the refrigeration energy from the high pressure liquefied natural gas (HP-LNG) stream 16. Stream 16, is counter-flowed to recovery heat exchanger 5, by incompressible fluid pump 15. The high pressure liquefied natural gas 16, that is counter-flowed through the recovery heat exchanger 5, transfers the refrigeration energy to the incoming natural gas 4, such that the pre-cooled natural gas stream 6, entering the expander 7A (e.g., a Joule-Thomson valve) is now a cold gas and/or a liquid. Stream 6 is processed through the Joule-Thomson valve (JT valve) 7A, for isenthalpic expansion, to further reduce the temperature of the natural gas and/or liquid stream 9, prior to entering the mechanical refrigeration unit 10. The Joule-Thomson (JT) expansion valve device provides isenthalpic expansion of the pre-cooled natural gas stream to further gain and impart refrigeration energy into the natural gas stream, prior to the mechanical refrigeration unit. The Joule-Thomson valve device can be used in place or in parallel with the Turbo-expander device. Certain conditions of the ICF Process System make it desirable to operate the Joule-Thomson valve device in place of the Turbo-Expander to provide a cooling effect to the natural gas stream, prior to entering the mechanical refrigeration unit.

When the ICF process system cycle of operation practice is continuous, the refrigeration liquefaction energy from stream 16 is continually recovered from the outgoing high-pressure natural gas stream 17 to the incoming pre-cooled natural gas stream 4. Additional, refrigeration is added to the stream by the JT Valve isenthalpic expansion process (7A) and mechanical refrigeration unit 10, to completely liquefy the steam to a saturated and sub-cooled thermodynamic condition 11. To provide the incompressible high-pressure fluid pump 15 with sufficient net positive suction head (NPSH), to prevent pump cavitation during transit conditions of start up, steady state and shutdown operations, a buffer storage unit 12 is provided in the ICF Process System.

Stream 13, contains cold gaseous natural gas vapor, which may be used for fuel and/or can be recompressed for injection into the ICF process System, after the cold refrigeration energy contain is this stream has been removed by recovery heat exchanger 5. Recovery of the refrigeration energy contained in stream 13 requires that, an additional heat exchange counter flow passage be added to recovery heat exchanger 5. The recovery of refrigeration energy from stream 13, further increases the thermal efficiency of the ICF Process System and lessens the total amount of energy required to charge high-pressure natural gas into underground reservoirs and or above ground storage containers.

High pressure natural gas stream 17, exiting the recovery heat exchanger 5, is controlled by valve 18, for pressure and flow in stream 19, to the underground storage facility 20 and or to above ground natural gas storage containers 21. Control valve 18 is further used to isolate the ICF system from the high pressure underground storage facility 20 and or the above ground high pressure storage containers 21, after charging operations have been completed and the ICF Process System has been shutdown.

The ICF Process System components, which are at or near cryogenic temperature such as the refrigeration recovery heat exchanger 5, pre-cooled natural gas stream 6, JT valve (7A), two phase cooled natural gas stream 9, mechanical refrigeration unit 10, saturated and or sub-cooled natural gas stream 11, buffer natural gas storage unit 12, pump suction stream 14, incompressible fluid pump 15 and high pressure natural gas stream 16, are highly insulated to retain the cold energy from heat gain due to thermal radiation and conduction. Thermal heat gain to the ICF Process System cryogenic or near cryogenic components requires additional refrigeration energy and lessens the overall system efficiency.

The FIGS. 3, 4, 5 and 6 contained in this disclosure, have been prepared using as an example a natural gas flow rate of 80 Million Standard Cubic Feet per Day (80 MMSCFD). The natural gas stream composition used for the same examples is composed of approximately 91.81 Mole percent Methane, 2.32 Mole percent Ethane, 2.27 Mole percent Propane, 1.45 Mole percent Nitrogen and 2.15 Mole percent Iso-Butane.

The technical chemical engineering data used for determining the ICF Process System performance, including compressor horsepower requirements, as described within this Invention Disclosure, has been calculated for the above natural gas stream at various inlet and outlet pressure conditions and equipment configurations, using computer simulations by Design II*, Version 8.19, Advanced Engineering Software program from WinSim Inc. Determination of the Sub-Temperature Refrigeration Horse power requirements has been determined from the refrigeration section of the handbook text, Rules of Thumb for Chemical Engineers, Second Edition, by Carl Branan.

ICF Process System piping components, which interconnect between the refrigeration energy recovery heat exchanger and turbo expander unit to conduct the pre-cooled natural gas stream, shall be insulated using a very low heat gain insulation system. The piping insulation system shall employ a vacuum jacket pipe, installed over the inner pressure carrier pipe. Further, the insulation system shall utilize vacuum and a laminar type super-insulation with a thermal conductivity equal to, or less than 0.015 Btu/foot, per hour, per degree F., of insulated pipe length. Those, skilled in the art of very low heat gain vacuum insulation systems, shall employ a getter and absorbent materials in the vacuum annular insulation space to provide for out-gassing of the stainless steel and or other steel and insulation materials, in order to maintain a long term vacuum and performance of the insulation system.

ICF Process System piping components which interconnect between turbo-expander unit and the mechanical refrigeration unit to conduct the near cryogenic or cryogenic natural gas stream, shall be insulated using a very low heat gain insulation system. The piping insulation shall employ a vacuum jacketed pipe, installed over the inner pressure carrier pipe. Further, the insulation system shall utilize vacuum and laminar type super-insulation with a thermal conductivity equal to, or less than 0.015 Btu/foot, per hour, per degree F., of insulated pipe length. Those, skilled in the art of very low heat gain vacuum insulation systems, shall employ a getter and absorbent materials in the vacuum annular insulation space to provide for out-gassing of the stainless steel and or other steel and insulation materials, in order to maintain a long term vacuum and performance of the insulation system.

ICF Process System piping components, which interconnect between the mechanical refrigeration unit and the buffer storage unit to conduct the saturated or sub-cooled near cryogenic or cryogenic natural gas stream, shall be insulated using a very low heat gain insulation system. The piping insulation system shall employ a vacuum jacketed pipe, installed over the inner pressure carrier pipe. Further, the insulation system shall utilize vacuum and laminar type super-insulation with a thermal conductivity equal to, or less than 0.015 Btu/foot, per hour, per degree F., of insulated pipe length. Those, skilled in the art of very low heat gain vacuum insulated systems, shall employ a getter and absorbent materials in the vacuum annular space to provide for out-gassing of the stainless steel and or other steel and insulation materials, in order to maintain a long term vacuum and performance of the insulation system.

ICF Process System buffer storage unit, which temporally contains or stores saturated or sub-cooled near-cryogenic or cryogenic liquefied natural gas for supply to the incompressible fluid pump shall be insulated using a very low heat gain insulation system. The buffer unit may be a pressure pipe or pressure vessel of sufficient volume for its purpose as previously described. The buffer unit insulation system shall employ a jacket pipe or jacket casing, installed over the pressure carrier inner pipe or inner pressure vessel. Further, the insulation system shall utilize vacuum and either a laminar type super-insulation or power type perlite insulation with a thermal conductivity equal to or less than 0.022 Btu/foot, per hour, per degree F., of insulated pipe length. Those, skilled in the art of very low heat gain vacuum insulated systems, shall employ a getter and absorbent materials in the vacuum annular space to provide for out-gassing of the stainless steel and or other steel and insulation materials, in order to provide for a long term vacuum and performance of the insulation system.

ICF Process System piping components, which interconnect between the buffer storage Unit and the incompressible fluid pump, to conduct the saturated or sub-cooled near cryogenic or cryogenic natural gas stream, shall be insulated with a very low heat gain insulation system. The piping insulation system shall employ a vacuum jacketed pipe, installed over the inner pressure carrier pipe. Further, the insulation system shall utilize vacuum and laminar type super-insulation with a thermal conductivity equal to, or less than 0.015 Btu/foot, per hour, per degree F., of insulated pipe length. Those, skilled in the art of very low heat gain insulation systems, shall employ a getter and absorbent materials in the vacuum annular space for out-gassing of the stainless steel and or other steel and insulation materials in order to maintain a long term vacuum and performance of the insulation system.

ICF Process System incompressible fluid pump, shall be insulated using a very low heat gain insulation system. The incompressible fluid pump may be a submerged type multi-stage centrifugal configuration and or a positive displacement type pump. The multi-stage centrifugal pump shall employ a vacuum jacket casing over the centrifugal pump housing. Further, the insulation system shall utilize vacuum and laminar type super-insulation with a thermal conductivity equal to, or less than 0.015 Btu/foot, per hour, per degree F., have insulated centrifugal pump length. Where, the incompressible fluid pump is a positive displacement type configuration, the pump cold end, shall employ a vacuum jacket casing over the cold end housing. Further, the insulation system shall utilize vacuum and laminar type super-insulation with a thermal conductivity equal to or less than 0.015 Btu/foot, per hour, per degree F., of insulated cold end housing length.

Those, skilled in the art of very low heat gain vacuum insulation systems, shall employ a getter and absorbent materials in the vacuum annular space, to provide for out-gassing of the stainless steel and or other steel and insulation materials, in order to maintain a long term vacuum and performance of the insulation system.

ICF Process System piping components, which interconnect between the incompressible fluid pump and the refrigeration recovery heat exchanger, shall be insulated with a very low heat gain insulation system. The piping insulation system shall employ a vacuum jacketed pipe, installed over the inner pressure carrier pipe. Further, the insulation system shall utilize a vacuum and laminar type super-insulation with a thermal conductivity of 0.015 Btu/foot, per hour, per degree F., of insulated pipe length. Those, skilled in the art of very low heat gain vacuum insulation systems, shall employ a getter and absorbent materials in the vacuum annular space, to provide for out-gassing of the stainless steel and or other steel and insulation materials, in order to maintain a long term vacuum and performance of the insulation system.

ICF Process System refrigeration energy recovery heat exchanger, shall be insulated with a low heat gain insulation system. The low heat gain insulation system to be employed for insulation of the refrigeration energy heat exchanger shall utilize a cryogenic type of urethane closed cell foam material. The foam material shall have a thermal conductivity equal to or less than 0.35 Btu/foot, per hour, per degree F., of exchanger length. Further, the foam insulation shall be a minimum thickness of 4 inches, placed in 2 inches thick panels. Yet further, the insulation shall be enclosed by an appropriate vapor shield material for protection of the urethane foam from moisture penetration and further damage due to ultra violet light and an aluminum metallic covering to protect the insulation vapor shield.

The disclosure includes the advantage of a continuous or near continuous system that (1) liquefies a gas to change from a compressible gas to an incompressible fluid, (2) uses an incompressible pump to raise the fluid's pressure, and (3) recovers most of the energy needed for liquefaction in step (1) from the now higher pressure fluid by heat exchange within the system as the fluid is returned to a gas at a now higher pressure.

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

What is claimed is:

1. A gas pressurization system comprising:

a gas inlet valve configured to receive an inlet gas stream;

a clean-up system coupled to said gas inlet valve, said clean-up system configured to remove impurities from said inlet gas stream;

a recovery heat exchanger coupled to said clean-up system, said recovery heat exchanger configured to remove thermal energy from said inlet gas stream and cool said inlet gas stream into one of a pre-cooled gas stream and a pre-cooled liquid stream;

an expander coupled to said recovery heat exchanger, said expander configured to expand said pre-cooled liquid stream into a two-phase fluid;

a refrigeration unit coupled to said expander, said refrigeration unit configured to cool said two-phase fluid into a liquid phase fluid;

a buffer storage unit coupled to said refrigeration unit, said buffer storage unit configured to provide a net positive suction head;

a pump coupled to said buffer storage unit at a pump suction, said pump having a pump discharge coupled to said recovery heat exchanger, wherein said recovery heat exchanger is configured to transfer thermal energy from said inlet gas stream to a liquid discharge from said pump discharge; and an underground natural gas reservoir coupled to said pump discharge downstream of said recovery heat exchanger, wherein said underground natural gas reservoir comprises at least one of a depleted natural gas or oil field, an aquifier, and a salt cavern.

2. The gas pressurization system of claim 1 further comprising:

fluid conduit coupling between said recovery heat exchanger, said expander, said refrigeration unit, said buffer storage unit, said pump, and said recovery heat exchanger, wherein said fluid conduit comprises very low heat gain insulation.

3. The gas pressurization system of claim 2 wherein said very low heat gain insulation comprises a vacuum jacket pipe disposed over an inner pipe and a vacuum.

4. The gas pressurization system of claim 1 further comprising:

a discharge control valve between said recovery heat exchanger and said underground natural gas reservoir, said discharge control valve configured to control gas flow to said underground natural gas reservoir.

5. The gas pressurization system of claim 1 further comprising:

an energy absorbing device coupled to said expander, wherein said energy absorbing device converts mechanical energy from said expander for use by said refrigeration unit.

6. The gas pressurization system of claim 5 wherein said energy absorbing device comprises at least one of an electrical generator, a gas compressor and a hydraulic pump.

7. The gas pressurization system of claim 1 wherein said expander comprises at least one of a turbo-expander and a Joule-Thomson valve.

8. The gas pressurization system of claim 1, wherein said refrigeration unit is configured to liquefy said vapor to one of a saturated and sub-cooled thermodynamic condition.

9. The gas pressurization system of claim 1 wherein said pump comprises at least one of a submerged multistage centrifugal pump and a positive displacement pump and a plurality of incompressible fluid pumps.

10. A gas pressurization system comprising:

a gas inlet valve, configured to receive an inlet natural gas stream;

a clean-up system coupled to said gas inlet valve, said clean-up system configured to remove impurities from said inlet natural gas stream;

a recovery heat exchanger coupled to said clean-up system, said recovery heat exchanger configured to remove thermal energy from said inlet natural gas stream and cool said inlet natural gas stream to one of a pre-cooled natural gas stream and a pre-cooled liquefied natural gas stream;

an expander coupled to said recovery heat exchanger, said expander configured to expand said pre-cooled liquefied natural gas stream into a two phase fluid;

a refrigeration unit coupled to said expander, said refrigeration unit configured to cool said two phase fluid to a liquid phase;

a buffer storage unit coupled to said refrigeration unit, said buffer storage unit configured to provide a net positive suction head;

a pump coupled to said buffer storage unit at a pump suction and said pump having a pump discharge coupled to said recovery heat exchanger, wherein said recovery heat exchanger is configured to transfer thermal energy from said inlet gas stream to a liquefied natural gas discharge from said pump discharge; and an underground natural gas reservoir coupled to said pump discharge downstream of said recovery heat exchanger, wherein said underground natural gas reservoir comprises at least one of a depleted natural gas or oil field, an aquifier, and a salt cavern.

11. The gas pressurization system of claim 10, wherein said clean-up system is configured to remove impurities selected from the group consisting of water, carbon dioxide, C6+, heavy hydrocarbons, and sulfur compounds.

12. The gas pressurization system of claim 10 wherein said expander comprises at least one of a turbo-expander and a Joule-Thomson valve.

13. The gas pressurization system of claim 10 further comprising:

an energy absorbing device coupled to said expander, wherein said energy absorbing device converts mechanical energy from said expander for use by said refrigeration unit, wherein said energy absorbing device comprises at least one of an electrical generator, a gas compressor and a hydraulic pump.

14. The gas pressurization system of claim 13 further comprising:

a gaseous natural gas stream coupled to said buffer storage unit and configured to provide at least one of a fuel for said refrigeration unit and an additional cooling fluid in said recovery heat exchanger.

15. The gas pressurization system of claim 10 wherein said refrigeration unit comprises at least one of a cascade refrigeration unit, a closed loop refrigeration unit and a plurality of refrigeration units.

16. A method of pressurizing a gas comprising:

flowing a gas through a gas inlet valve;

removing impurities from said gas;

precooling said gas in a recovery heat exchanger into one of a gas phase and a liquid phase;

expanding said liquid phase to a two-phase fluid through an expander;

cooling said two-phase fluid to one of a saturated and a sub-cooled liquid;

storing said saturated sub-cooled liquid in a buffer storage unit;

maintaining a net positive suction head in said saturated liquid and said sub-cooled liquid;

pumping said saturated liquid and said sub-cooled liquid with a pump through said recovery heat exchanger;

exchanging thermal energy from said gas to said saturated liquid and said sub-cooled liquid in said recovery heat exchanger; and storing a high pressure natural gas in an underground natural gas reservoir, wherein said underground natural gas reservoir comprises at least one of a depleted natural gas or oil field, an aquifier, and a salt cavern.

17. The method of claim 16 wherein said expanding said liquid phase to a two phase fluid includes at least one of expansion through a turbo-expander and expansion through a Joule-Thomson valve.

18. The method of claim 16 further comprising:

absorbing mechanical energy from said expander with an energy absorbing device, said energy absorbing device including at least one of an electrical generator, a gas compressor and a hydraulic pump.

19. The method of claim 16 wherein said gas is natural gas and said liquid is liquefied natural gas.

* * * * *